US011668206B1

(12) United States Patent
Safford et al.

(10) Patent No.: US 11,668,206 B1
(45) Date of Patent: Jun. 6, 2023

(54) TEMPERATURE GRADIENT CONTROL SYSTEM FOR A COMPRESSOR CASING

(71) Applicant: GENERAL ELECTRIC COMPANY, Schenectady, NY (US)

(72) Inventors: Kyle Safford, Greenville, SC (US); Kyle Benson, Greenville, SC (US); Mithun Raj K K, Bangalore (IN); Radu I. Danescu, Greenville, SC (US); Richard W. Johnson, Greenville, SC (US); Joseph M. Harvey, Greenville, SC (US); Brian P. Hansen, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/654,142

(22) Filed: Mar. 9, 2022

(51) Int. Cl.

| | |
|---|---|
| ***F01D 21/12*** | (2006.01) |
| ***F01D 25/26*** | (2006.01) |
| ***F01D 25/14*** | (2006.01) |
| ***F01D 17/14*** | (2006.01) |
| ***F01D 21/00*** | (2006.01) |

(52) U.S. Cl.
CPC ..... *F01D 21/12* (2013.01); *F01D 17/145* (2013.01); *F01D 21/003* (2013.01); *F01D 25/14* (2013.01); *F01D 25/26* (2013.01); *F05D 2260/232* (2013.01); *F05D 2260/60* (2013.01); *F05D 2270/303* (2013.01); *F05D 2270/3013* (2013.01); *F05D 2270/80* (2013.01)

(58) Field of Classification Search
CPC ..... F01D 21/12; F01D 17/145; F01D 21/003; F01D 25/14; F01D 25/26; F05D 2260/232; F05D 2260/60; F05D 2270/3013; F05D 2270/303; F05D 2270/80
See application file for complete search history.

(56) References Cited

U.S. PATENT DOCUMENTS

| | | | | |
|---|---|---|---|---|
| 8,177,483 | B2 | 5/2012 | McCallum | |
| 10,233,845 | B2 * | 3/2019 | Moniz | F02C 7/20 |
| 2003/0120415 | A1 * | 6/2003 | Seeley | F01D 25/26 701/100 |
| 2012/0266601 | A1 * | 10/2012 | Miller | F01D 25/14 60/39.83 |
| 2014/0060068 | A1 * | 3/2014 | Lee | F02C 7/18 60/775 |
| 2014/0321981 | A1 * | 10/2014 | Rodriguez | F01D 25/26 415/116 |
| 2015/0071767 | A1 | 3/2015 | Johnson et al. | |
| 2017/0175769 | A1 | 6/2017 | Sun et al. | |
| 2017/0321570 | A1 * | 11/2017 | Scothern | F02C 9/18 |
| 2018/0010617 | A1 | 1/2018 | Casavant et al. | |
| 2018/0340468 | A1 * | 11/2018 | Takamura | F02C 9/18 |
| 2019/0162203 | A1 * | 5/2019 | Shinde | F02C 7/18 |

* cited by examiner

*Primary Examiner* — Jesse S Bogue
(74) *Attorney, Agent, or Firm* — Eversheds Sutherland (US) LLP

(57) ABSTRACT

This application provides a temperature gradient control system for a double wall casing of a compressor. The double wall casing may include an inner casing and an outer casing such that a flow of air is pulled through the double wall casing. The temperature gradient control system may include upper discharge piping with an upper modulation valve and a lower discharge piping with a lower modulation valve. The upper modulation valve and/or the lower modulation valve modulate the flow air pulled through the double wall casing to reduce a temperature gradient across the outer casing.

20 Claims, 4 Drawing Sheets

TEMPERATURE GRADIENT CONTROL SYSTEM FOR A COMPRESSOR CASING

TECHNICAL FIELD

The present application and the resultant patent relate generally to gas turbine engines and more particularly relate to systems and methods for controlling temperature gradients across an outer compressor casing during startup and other types of operations. A gas turbine engine generally includes a compressor, a combustor, and a turbine.

BACKGROUND

The combustor combusts fuel with compressed air from the compressor and provides hot combustion gases to the turbine to drive a load such as an electric generator and the like. One focus of overall gas turbine engine efficiency is to limit the extent of a gap between compressor blades and turbine blades and the respective casings while avoiding the blades rubbing against the casings.

In some compressors having a double wall casing, a cavity exists between an inner casing and an outer casing on a double wall compressor casing with no dedicated airflow therethrough. During startup, this cavity may experience buoyant plume effects that cause an air temperature differential inside the cavity. This temperature differential may drive a corresponding metal temperature gradient in the outer casing. If not managed, the outer casing temperature gradient may cause a "bowing" or a centerline shift of the entire gas turbine static structure relative to the rotating blades, sometimes referred to as "cat-back" or "eccentricity". If the static casing centerline shift is great enough, such a shift may lead to blade tip rubs, hardware damage, open clearances, efficiency losses, startup delays, and degraded overall engine performance.

SUMMARY

This application and the resultant patent provide a temperature gradient control system for a double wall casing of a compressor. The double wall casing may include an inner casing and an outer casing such that cavity is defined therebetween and a flow of air is pulled through the cavity. The temperature gradient control system may include upper discharge piping with an upper modulation valve and a lower discharge piping with a lower modulation valve. The upper modulation valve and/or the lower modulation valve modulate the flow of air pulled through the cavity of the double wall casing to reduce a temperature gradient across the outer casing.

This application and the resultant patent further provide a method of reducing a temperature gradient across an outer casing of a double wall compressor casing during. The method may include the steps of pulling an air flow into a cavity between an inner casing and an outer casing of the double wall compressor casing, extracting the air flow from a top and a bottom of the double wall compressor casing, measuring a temperature of the outer casing at the top and the bottom, and modulating the air flow through the top and the bottom of the outer casing depending upon the measured temperatures of the outer casing at the top and the bottom.

This application and the resultant patent further provide a temperature gradient control system for a double wall casing of a compressor. The double wall casing may include an inner casing and an outer casing such that a cavity is defined therebetween and a flow of air is pulled through the cavity. The temperature gradient control system may include upper discharge piping with an upper modulation valve and a lower discharge piping with a lower modulation valve. An upper thermocouple and a lower thermocouple may be positioned on the outer casing. The upper modulation valve and/or the lower modulation valve modulate the flow of air being pulled through the cavity of the double wall casing to reduce a temperature gradient across the outer casing as determined by the upper thermocouple and lower thermocouple.

These and other features and improvements of this application and the resultant patent will become apparent to one of ordinary skill in the art upon review of the following detailed description when taken in conjunction with the several drawings and the appended claims.

DETAILED DESCRIPTION

Figure 1:
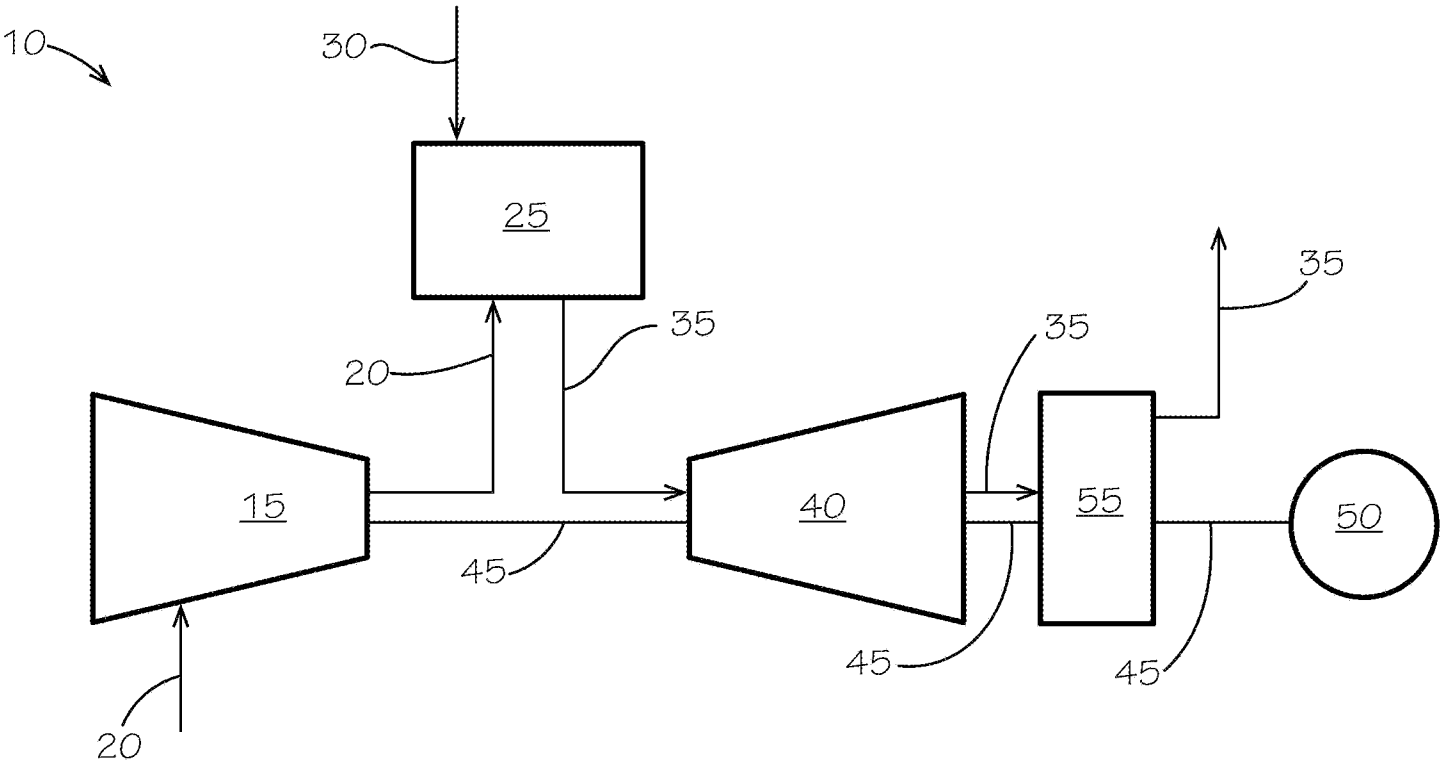
FIG. 1 is a schematic diagram of a gas turbine engine including a compressor, a combustor, a turbine, an exhaust frame, and an external load.

Referring now to the drawings, in which like numerals refer to like elements throughout the several views, FIG. 1 shows a schematic diagram of gas turbine engine 10 as may be used herein. The gas turbine engine 10 may include a compressor 15. The compressor 15 compresses an incoming flow of air 20. The compressor 15 delivers the compressed flow of air 20 to a number of combustor cans 25. The combustor cans 25 mix the compressed flow of air 20 with a pressurized flow of fuel 30 and ignite the mixture to create a flow of hot combustion gases 35. Although only a single combustor can 25 is shown, the gas turbine engine 10 may include any number of combustor cans 25 positioned in a circumferential array and the like. Alternatively, the combustor 25 may be an annular combustor. The flow of the hot combustion gases 35 is in turn delivered to a turbine 40. The flow of the hot combustion gases 35 drives the turbine 40 so as to produce mechanical work. The turbine 40 is coupled to the shaft 15 and an external load 50 (such as an electrical generator), such that the mechanical work produced in the turbine 40 drives the compressor 15 and the external load 50.

The flow of combustion gases 35 is delivered from the turbine 40 to an exhaust frame 55 positioned downstream thereof. The exhaust frame 55 may contain and direct the flow of combustion gases 35 to other components of the gas turbine engine 10. For example, the exhaust frame 55 may direct the flow of combustion gases 35 to an exhaust plenum or an exhaust diffuser. Other configurations and other components may be used herein.

The gas turbine engine 10 may use natural gas, various types of syngas, liquid fuels, and/or other types of fuels and blends thereof. The gas turbine engine 10 may be any one of a number of different gas turbine engines offered by General Electric Company of Schenectady, N.Y., including, but not limited to, those such as a 7- or a 9-series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
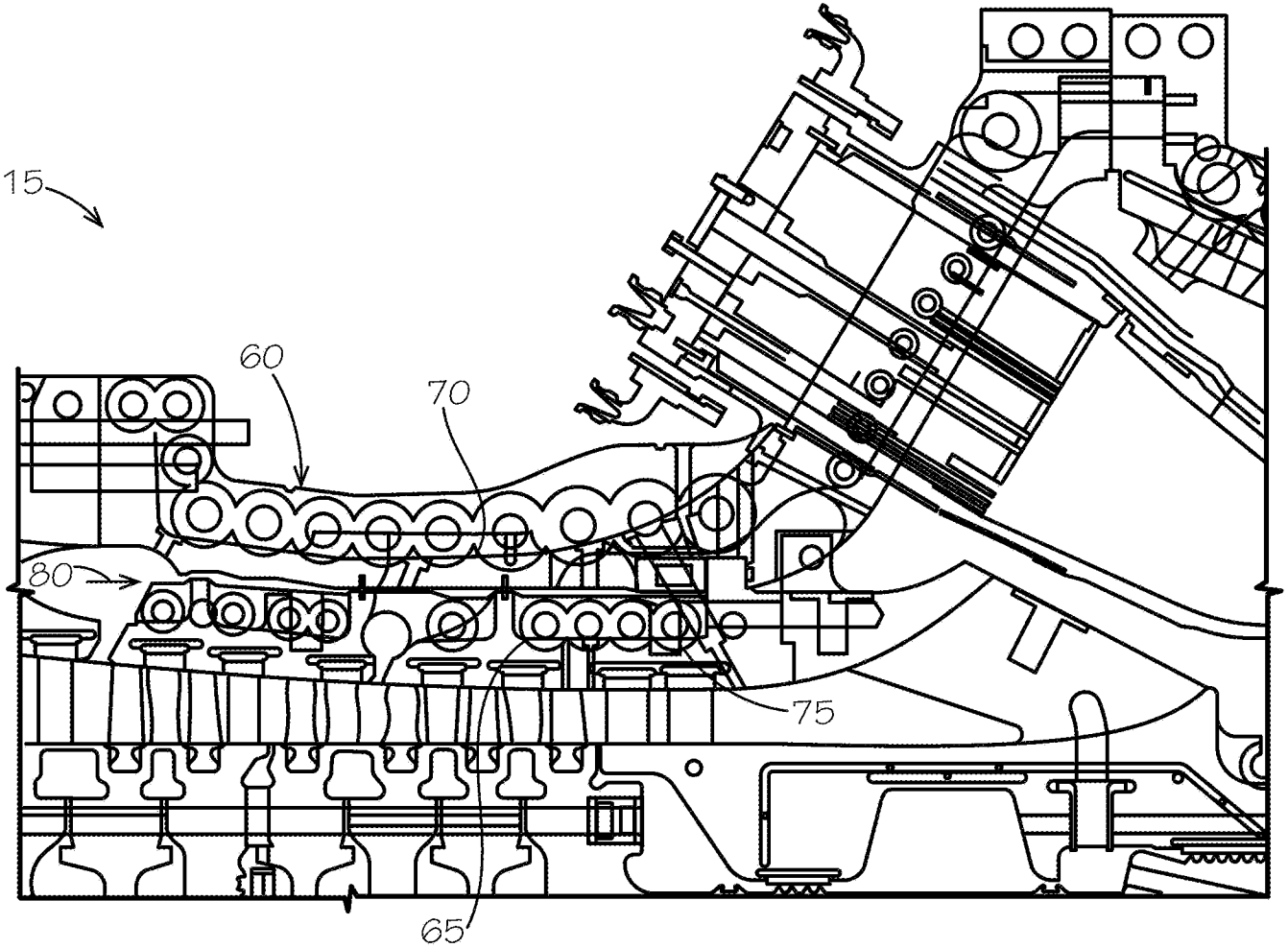
FIG. 2 is a partial sectional view of the compressor of the gas turbine engine of FIG. 1.

FIG. 2 shows the compressor 15 in greater detail. In this example, the compressor 15 may include a double wall compressor casing 60. The double wall compressor casing 60 may have an inner casing 65 and an outer casing 70. The inner casing 65 and the outer casing 70 define a cavity 75 therebetween.

As described above, in conventional double wall compressors, the cavity 75 may have no dedicated airflow therethrough. During startup, the cavity 75 may experience buoyant plume effects that cause an air temperature differential inside the cavity 75. Specifically, hot compressor discharge air 80 may be pulled within the cavity 75. Once inside, the colder outer casing 70 wants to cool the air 80 which sinks to a bottom 85 (FIG. 3) of the cavity 75. Although the warmer inner casing 65 may be largely heat transfer neutral, a portion of the air 80 may float to a top 90 (FIG. 3) of the cavity 75. This temperature differential may drive a corresponding metal temperature gradient in the outer casing 70 and create the resultant eccentricity and the issues therewith.

Figure 3:
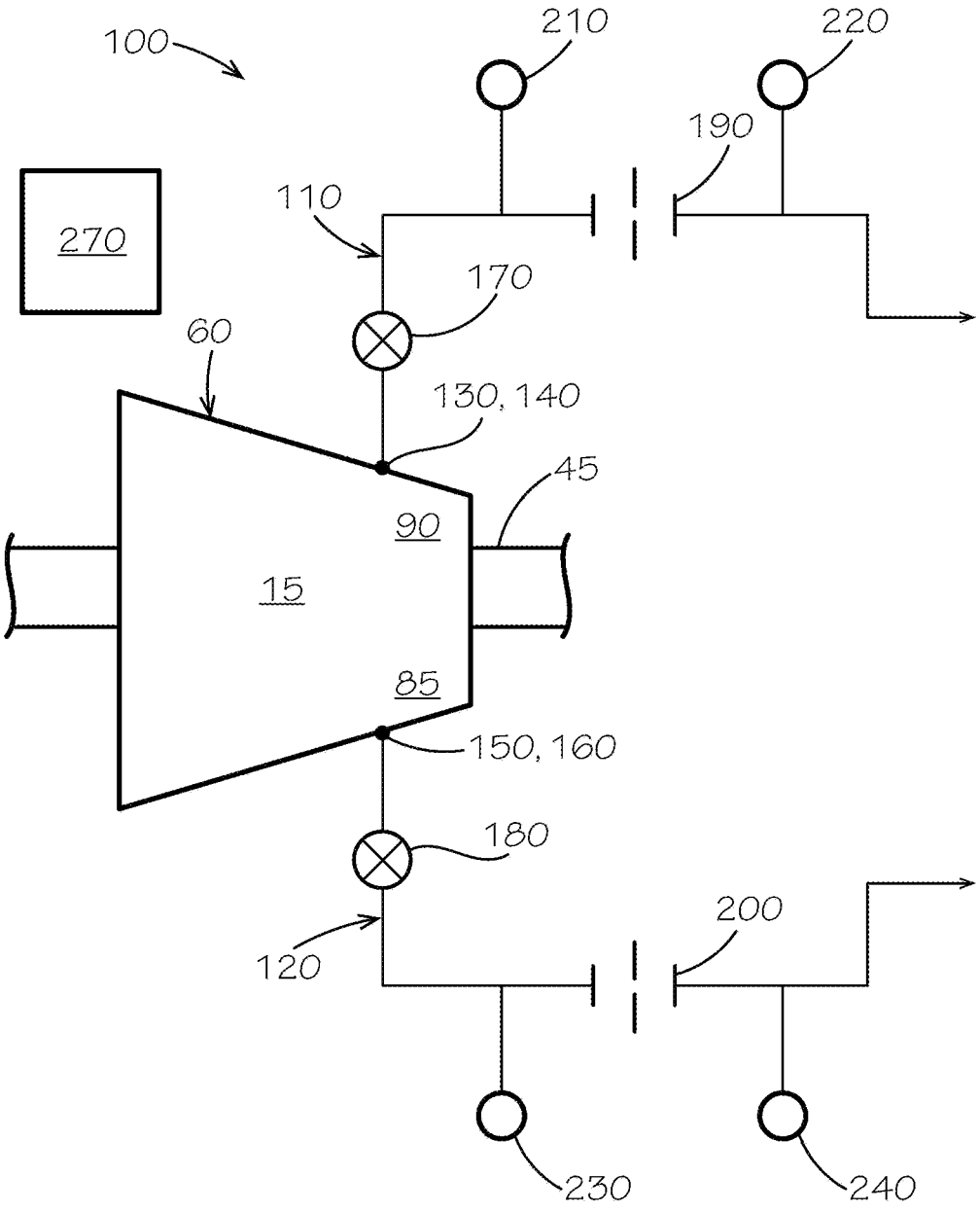
FIG. 3 is a schematic view of a temperature gradient control system for a compressor as may be described herein.
Figure 4:
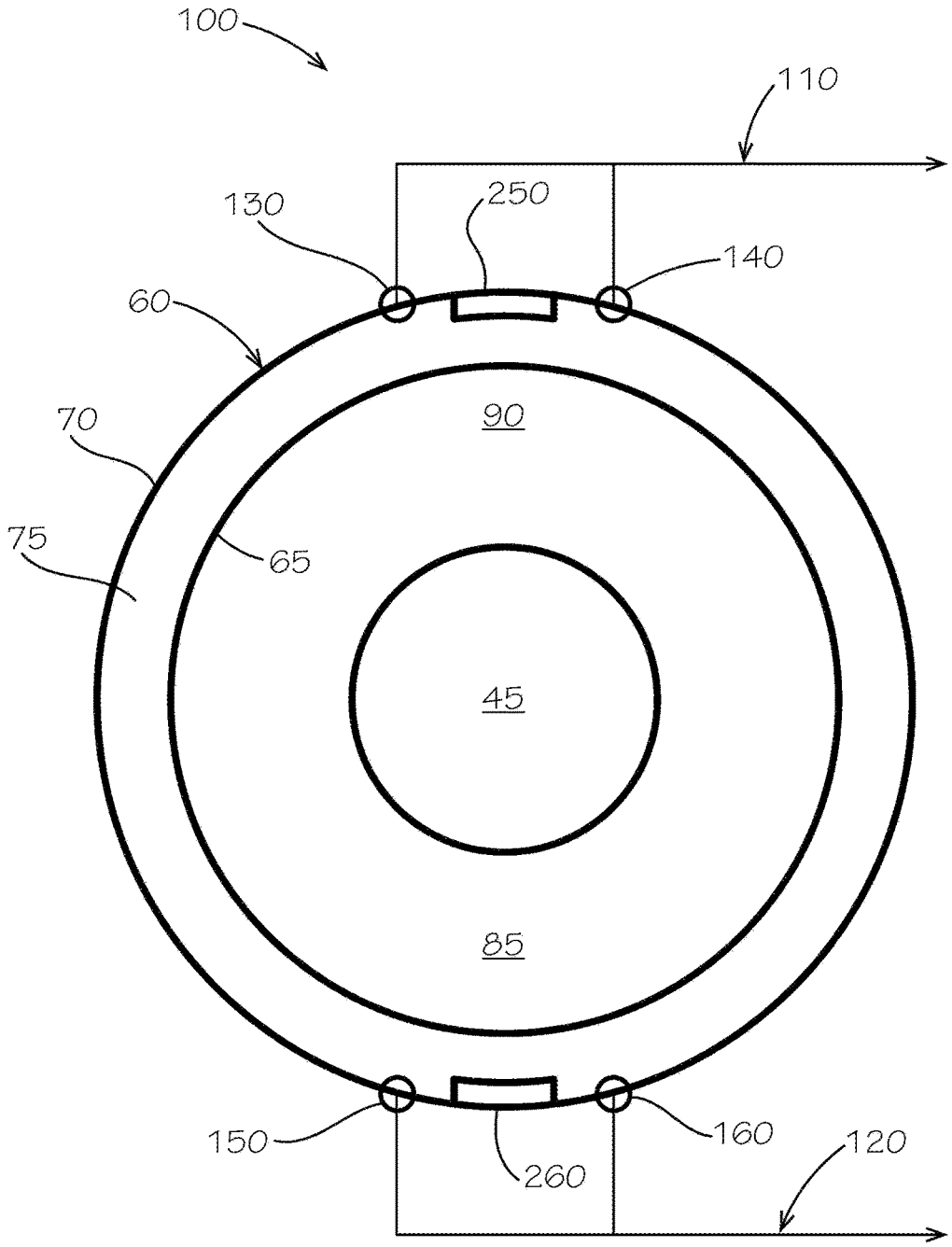
FIG. 4 is a further schematic view of the temperature gradient control system of FIG. 3.

FIGS. 3 and 4 show a temperature gradient control system 100 for use with the double wall compressor casing 60 of the compressor 15 and the like. The temperature gradient control system 100 directs the flow of the hot compressor discharge air 80 through and out of the cavity 75 between the inner casing 65 and the outer casing 70 of the double wall compressor casing 60 of the compressor 15. The temperature gradient control system 100 may include upper discharge piping 110 and lower discharge piping 120. The upper discharge piping 110 may be connected to, or proximate to, the top 90 of the outer casing 70 by one or more top extraction ports. In this example, a first top extraction port 130 and a second top extraction port 140 are shown although any number of the top extraction ports may be used. The top extraction ports 130, 140 may be existing apertures in the outer casing 70 or otherwise provided. The upper discharge piping 110 may be connected to the top extraction ports 130, 140 by T-joints or other types of connections. Other components and other configurations may be used herein.

The lower discharge piping 120 may be connected to, or proximate to, the bottom 85 of the outer casing 70 by one or more bottom extraction ports. In this example, a first bottom extraction port 150 and a second bottom extraction port 160 are shown although any number of the bottom extraction ports may be used. The bottom extraction ports 150, 160 may be existing apertures in the outer casing 70 or otherwise provided. The bottom discharge piping 110 may be connected to the bottom extraction ports 150, 160 by T-joints or other connections. Other components and other configurations may be used herein.

The upper discharge piping 110 and the lower discharge piping 120 may operate together or independently of each other. As described below, the upper discharge piping 110 and the lower discharge piping 120 may direct the hot compressor discharge air 80 downstream or in any safe direction. The discharge piping 110, 120 may each have one or more valves thereon. In this example, an upper discharge piping valve 170 and a lower discharge piping valve 180 are shown although any number of the valves may be used. The valves 170, 180 may be largely open/closed type valves such as a solenoid valve and the like. Other types of valves may be used herein.

The flow of the hot compressor discharge air 80 through the upper discharge piping 110 and the lower discharge piping 120 may be controlled through one or more modulation valves. In this example, an upper modulation valve 190 and a lower modulation valve 200 are shown although any number may be used. The modulation valves 190, 200 may be opening/closing, on/off valves with orifice plates, variable opening valves, and the like. Any type of variable flow valve may be used herein. The modulation valves 190, 200 may operate together or independently. The modulation valves 190, 200 may modulate the flow to any desired percentage and/or may completely shut either the upper discharge piping 110 or the lower discharge piping 120 preventing the flow through the respective discharge piping 110, 120. Other components and other configurations may be used herein.

The nature of the flow of the hot compressor discharge air 80 through the upper discharge piping 110 and the lower discharge piping 120 may be monitored via one or more pressure transducers positioned on either side of the modulation valves 190, 200 or elsewhere. In this example, a first upper transducer 210, a second upper transducer 220, a first lower transducer 230, and a second lower transducer 240 are shown although any number of transducers may be used. The transducers 210, 220, 230, 240 may be standard pressure transducers and the like. Other components and other configurations may be used herein.

As described above, the upper discharge piping 110 and the lower discharge piping 120 may extend downstream of the compressor 15 or elsewhere. The upper discharge piping 110 and the lower discharge piping 120 may route the hot compressor discharge air 80 into an existing compressor bleed pipe, into an exhaust duct, to the atmosphere, or elsewhere. Because the pressure of the exiting compressor discharge air is at a lower pressure than the pressure of the compressor discharge air 80 entering the double wall compressor casing 60, the air 80 exiting the upper and/or lower discharge piping 110, 120 may be pulled downstream without the use of fans or other types of air movement devices.

The nature of the temperature gradient across the outer casing 70 may be determined by one or more thermocouples positioned thereon. In this example, an upper thermocouple 250 and a lower thermocouple 260 are shown although any number may be used. The thermocouples 250, 260 may be conventional temperature measuring devices and the like. Other components and other configurations may be used herein.

The discharge piping valves 170, 180, the modulation valves 190, 200, the transducers 210, 220, 230, 240, and the thermocouples 250, 260 may be in communication with a controller 270. The controller 210 may be any type of programmable logic device, such as a microcomputer and the like, operated by control logic. More than one controller 270 may be used. The controller 270 may be dedicated to the temperature gradient control system 100 or part of the overall control of the gas turbine engine 10. The controller 270 may be local or remote. Connections between the controller 270 and the various components are not shown for purposes of clarity.

In use, the hot compressor discharge air 80 may be pulled into the cavity 75 of the double wall compressor casing 60 and may be extracted via the temperature gradient control system 100 via the pressure differential therethrough. The airflow therethrough thus is sufficient to wash out or at least significantly reduce the temperature gradients across circumferential expanse of the outer casing 70.

Specifically, the temperature gradient control system 100 may be activated during gas turbine engine startup. The nature of the temperature gradient may be monitored via the thermocouples 250, 260 on the outer casing 70. The upper discharge piping 110 and the lower discharge piping 120 may be operated independently and the flow therethough may be modulated via the controller 270. For example, if the top 90 of the outer casing 70 is warmer than the bottom 85, the respective modulation valves 190, 200 may be set such that more of the flow of air 80 flows through the lower discharge piping 120 so as to heat the bottom 85 of the outer casing 70. The respective air flows 80 may become more similar in temperature as the temperature gradients are reduced. In addition to the real-time thermocouple data, the controller 270 also may consider other engine parameters and/or a prescribed schedule of operation.

The temperature gradient control system 100 may be shut off once both casings 65, 70 are hot so as to not impact overall engine performance at base load conditions. At that point, the temperature gradient has been reduced and the clearance pinch point has passed. The temperature gradient control system 100 thus may allow tighter blade clearances, which provide improved compressor efficiency, improved overall gas turbine engine performance, and faster startups. The temperature gradient control system 100 may be used in new equipment or may be installed as a part of a retrofit.

Although the temperature gradient control system 100 has been described in the context of startup, the temperature gradient control system 100 also may be activated during shutdown and other operations so as to limit any temperature gradients associated with those operations. For example, the temperature gradient control system 100 may be activated if a temperature gradient is detected by the thermocouples 250, 260 or otherwise. Likewise, although the temperature gradient control system 100 has been described in the context of the inner casing 65 and the outer casing 70 of the double wall compressor casing 60, the temperature gradient control system 100 may be used for any "dead" cavity between any inner casing and outer casing (for example, a turbine casing or any casing without a dedicated airflow therethrough).

It should be apparent that the foregoing relates only to certain embodiments of this application and resultant patent. Numerous changes and modifications may be made herein by one of ordinary skill in the art without departing from the general spirit and scope of the invention as defined by the following claims and the equivalents thereof.

The subject matter of the present disclosure may be described in various clauses, as provided below:

A first aspect provides a temperature gradient control system for a double wall casing of a compressor, wherein the double wall casing comprises an inner casing and an outer casing defining a cavity therebetween and wherein a flow of air is pulled through the cavity, the temperature gradient control system comprising: an upper discharge piping proximate to a top of the double wall casing and in fluid communication with the cavity at the top of the double wall casing, the upper discharge piping comprising an upper modulation valve; a lower discharge piping proximate to a bottom of the double walled casing and in fluid communication with the cavity at the bottom of the double wall casing, the lower discharge piping comprising a lower modulation valve; and wherein the upper modulation valve and/or the lower modulation valve modulate the flow of air pulled through the cavity of the double wall casing to reduce a temperature gradient across the outer casing.

The temperature gradient control system of the previous clause further comprises one or more top extraction ports on the outer casing in communication with the upper discharge piping.

The temperature gradient control system of any preceding clause further comprises one or more bottom extraction ports on the outer casing in communication with the lower discharge piping.

The temperature gradient control system of any preceding clause, wherein the upper discharge piping comprises an upper on/off valve in addition to the upper modulation valve.

The temperature gradient control system of any preceding clause, wherein the lower discharge piping comprises a lower on/off valve in addition to the lower modulation valve.

The temperature gradient control system of any preceding clause, wherein the upper modulation valve comprises an upper variable flow valve.

The temperature gradient control system of any preceding clause, wherein the lower modulation valve comprises a lower variable flow valve.

The temperature gradient control system of any preceding clause, wherein the upper discharge piping comprises one or more upper pressure transducers thereon.

The temperature gradient control system of any preceding clause, wherein the upper discharge piping comprises a first upper transducer upstream of the upper modulation valve and a second upper transducer downstream of the upper modulation valve.

The temperature gradient control system of any preceding clause, wherein the lower discharge piping comprises one or more lower pressure transducers thereon.

The temperature gradient control system of any preceding clause, wherein the lower discharge piping comprises a first lower transducer upstream of the lower modulation valve and a second lower transducer downstream of the lower modulation valve.

The temperature gradient control system of any preceding clause, further comprising an upper thermocouple positioned on the outer casing proximate to the upper discharge piping.

The temperature gradient control system of any preceding clause, further comprising a lower thermocouple positioned on the outer casing proximate to the lower discharge piping.

The temperature gradient control system of any preceding clause, further comprising a controller in communication with the upper modulation valve and the lower modulation valve.

A second aspect provides a method of reducing a temperature gradient across an outer casing of a double wall compressor casing, the method comprising: pulling an air flow into a cavity between an inner casing and an outer casing of the double wall compressor casing; extracting the air flow from a top and a bottom of the double wall compressor casing; measuring a temperature of the outer casing at the top and the bottom; and modulating the air flow through the top and the bottom of the outer casing depending upon the measured temperatures of the outer casing at the top and the bottom.

A third aspect provides a compressor comprising: an inner casing and an outer casing defining a cavity therebetween and wherein a flow of air is pulled through the cavity; and a temperature gradient control system comprising: an upper discharge piping disposed proximate to a top of the double wall casing and in fluid communication with the cavity at the top of the double wall casing, the upper discharge piping comprising an upper modulation valve; a lower discharge piping disposed proximate to a bottom of the double wall casing and in fluid communication with the cavity at the bottom of the double wall casing, the lower discharge piping comprising a lower modulation valve; an upper thermocouple positioned on the outer casing proximate to the upper discharge piping; and a lower thermocouple positioned on the outer casing proximate to the lower discharge piping; wherein the upper modulation valve and/or the lower modulation valve modulate the flow of air pulled through the cavity of the double wall casing to reduce a temperature gradient across the outer casing as measured by the upper thermocouple and the lower thermocouple.

The compressor of the preceding clause, wherein the upper discharge piping comprises an upper on/off valve in addition to the upper modulation valve, and the lower discharge piping comprises a lower on/off valve in addition to the lower modulation valve.

The compressor of any preceding clause, wherein the upper modulation valve comprises an upper variable flow valve, and the lower modulation valve comprises a lower variable flow valve.

The compressor of any preceding clause, wherein the upper discharge piping comprises one or more upper pressure transducers thereon, and the lower discharge piping comprises one or more lower pressure transducers thereon.

The compressor of any preceding clause, further comprising a controller in communication with the upper modulation valve, the lower modulation valve, the upper thermocouple, and the lower thermocouple.

We claim:

1. A temperature gradient control system for a double wall casing of a compressor, wherein the double wall casing comprises an inner casing and an outer casing and wherein a flow of air is pulled through the double wall casing via a pressure differential from the compressor when the compressor is operating, the temperature gradient control system comprising:

upper discharge piping in communication with a top of the double wall casing;

the upper discharge piping comprising an upper modulation valve;

lower discharge piping in communication with a bottom of the double walled casing;

the lower discharge piping comprising a lower modulation valve; and wherein the upper modulation valve and/or the lower modulation valve modulate the flow of air pulled through the double wall casing to reduce a temperature gradient across the outer casing.

2. The temperature gradient control system of claim 1, further comprising one or more top extraction ports on the outer casing in communication with the upper discharge piping.

3. The temperature gradient control system of claim 1, further comprising one or more bottom extraction ports on the outer casing in communication with the lower discharge piping.

4. The temperature gradient control system of claim 1, wherein the upper discharge piping comprises an upper on/off valve in addition to the upper modulation valve.

5. The temperature gradient control system of claim 1, wherein the lower discharge piping comprises a lower on/off valve in addition to the lower modulation valve.

6. The temperature gradient control system of claim 1, wherein the upper modulation valve comprises an upper variable flow valve.

7. The temperature gradient control system of claim 1, wherein the lower modulation valve comprises a lower variable flow valve.

8. The temperature gradient control system of claim 1, wherein the upper discharge piping comprises one or more upper pressure transducers thereon.

9. The temperature gradient control system of claim 1, wherein the upper discharge piping comprises a first upper transducer upstream of the upper modulation valve and a second upper transducer downstream of the upper modulation valve.

10. The temperature gradient control system of claim 1, wherein the lower discharge piping comprises one or more lower pressure transducers thereon.

11. The temperature gradient control system of claim 1, wherein the lower discharge piping comprises a first lower transducer upstream of the lower modulation valve and a second lower transducer downstream of the lower modulation valve.

12. The temperature gradient control system of claim 1, further comprising an upper thermocouple positioned on the outer casing.

13. The temperature gradient control system of claim 1, further comprising a lower thermocouple positioned on the outer casing.

14. The temperature gradient control system of claim 1, further comprising a controller in communication with the upper modulation valve and the lower modulation valve.

15. A method of reducing a temperature gradient across an outer casing of a double wall compressor casing, the method comprising:

pulling an air flow into the double wall compressor casing via a pressure differential from the compressor when the compressor is operating;

extracting the air flow from a top and a bottom of the double wall compressor casing;

measuring a temperature of the outer casing at the top and the bottom; and modulating the air flow through the top and the bottom of the outer casing depending upon the measured temperatures of the outer casing at the top and the bottom.

16. A compressor, comprising:

an inner casing and an outer casing defining a cavity therebetween and wherein a flow of air is pulled through the cavity via a pressure differential from the compressor when the compressor is operating; and a temperature gradient control system, comprising:

an upper discharge piping disposed proximate to a top of the double wall casing, the upper discharge piping comprising an upper modulation valve;

a lower discharge piping disposed proximate to a bottom of the double wall casing, the lower discharge piping comprising a lower modulation valve;

a upper thermocouple positioned on the outer casing proximate to the upper discharge piping;

a lower thermocouple positioned on the outer casing proximate to the lower discharge piping; and wherein the upper modulation valve and/or the lower modulation valve modulate the flow of air pulled through the cavity of the double wall casing to reduce a temperature gradient across the outer casing as measured by the upper thermocouple and the lower thermocouple.

17. The compressor of claim 16, wherein the upper discharge piping comprises an upper on/off valve in addition to the upper modulation valve, and the lower discharge piping comprises a lower on/off valve in addition to the lower modulation valve.

18. The compressor of claim 16, wherein the upper modulation valve comprises an upper variable flow valve and the lower modulation valve comprises a lower variable flow valve.

19. The compressor of claim 16, wherein the upper discharge piping comprises one or more upper pressure transducers thereon and the lower discharge piping comprises one or more lower pressure transducers thereon.

20. The compressor of claim 16, further comprising a controller in communication with the upper modulation valve, the lower modulation valve, the upper thermocouple, and the lower thermocouple.

* * * * *